US008087569B2

(12) United States Patent
Ledvina

(10) Patent No.: US 8,087,569 B2
(45) Date of Patent: Jan. 3, 2012

(54) POLYGONAL TRAY HAVING REINFORCED CORNERS

(75) Inventor: Larry Ledvina, Buena Park, CA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 89 days.

(21) Appl. No.: 12/425,491

(22) Filed: Apr. 17, 2009

(65) Prior Publication Data

US 2009/0266873 A1 Oct. 29, 2009

Related U.S. Application Data

(60) Provisional application No. 61/047,776, filed on Apr. 25, 2008.

(51) Int. Cl.
*B65D 5/20* (2006.01)

(52) U.S. Cl. ..... 229/108; 229/164; 229/187

(58) Field of Classification Search ..... 229/187, 229/108, 918, 919, 166, 185.1, 906
See application file for complete search history.

(56) References Cited

U.S. PATENT DOCUMENTS

| | | | | |
|---|---|---|---|---|
| 2,522,597 | A * | 9/1950 | Blandford | 229/192 |
| 3,034,698 | A * | 5/1962 | Forrer | 229/117.04 |
| 3,055,573 | A * | 9/1962 | Carter | 229/178 |
| 4,056,223 | A * | 11/1977 | Williams | 229/160 |
| 4,792,084 | A * | 12/1988 | Dreeszen | 229/109 |
| 5,000,377 | A * | 3/1991 | McClure | 229/154 |
| 5,147,271 | A | 9/1992 | Bacques et al. | |
| 5,160,307 | A | 11/1992 | Bacques et al. | |
| 5,295,623 | A | 3/1994 | Bacques et al. | |
| 5,375,715 | A | 12/1994 | Serre et al. | |
| 5,381,948 | A | 1/1995 | Coalier et al. | |
| 5,395,043 | A | 3/1995 | Bacques et al. | |
| 5,752,648 | A | 5/1998 | Quaintance | |
| 5,878,946 | A | 3/1999 | Frerot et al. | |
| 5,988,389 | A | 11/1999 | Buscema | |

(Continued)

FOREIGN PATENT DOCUMENTS

DE 20316273 U1 3/2004

(Continued)

OTHER PUBLICATIONS

International Search Report and Written Opinion of the Intenatonal Searching Auhorty for PCT/US2009/041368 maild Jun. 29, 2009.

(Continued)

*Primary Examiner* — Nathan J Newhouse
*Assistant Examiner* — Christopher Demeree
(74) *Attorney, Agent, or Firm* — William W. Letson

(57) ABSTRACT

A tray includes a bottom panel having first, second, third and fourth edge portions. The tray further includes at least one end wall that extends perpendicularly outward from one of the first, second, third and fourth edge portions of the bottom panel, and at least one side wall that extends perpendicularly outward from another of the first, second, third, and fourth edge portions of the bottom panel. The at least one side wall is perpendicular to the at least one end wall. At least one corner extends between the at least one side wall and the at least one end wall. The at least one corner includes an outer member and an inner member. The inner member is folded onto the outer member to reinforce the at least one corner.

13 Claims, 4 Drawing Sheets

U.S. PATENT DOCUMENTS

| | | | | |
|---|---|---|---|---|
| 6,131,805 | A | 10/2000 | Gasior | |
| 6,257,411 | B1 | 7/2001 | Bacques et al. | |
| 6,264,034 | B1 | 7/2001 | Bacques et al. | |
| 6,394,742 | B1 | 5/2002 | Buscema | |
| 6,598,785 | B2 | 7/2003 | Quaintance | |
| 6,675,970 | B1 * | 1/2004 | Nemoto | 206/521 |
| 6,749,107 | B2 | 6/2004 | Quaintance | |
| 7,922,069 | B2 | 4/2011 | Gardner | |
| 2005/0145684 | A1 * | 7/2005 | Gaeta | 229/109 |
| 2009/0266874 | A1 | 10/2009 | Smith | |
| 2009/0277952 | A1 * | 11/2009 | Smith | 229/109 |
| 2011/0053746 | A1 | 3/2011 | Desertot et al. | |
| 2011/0111938 | A1 | 5/2011 | Smith | |

FOREIGN PATENT DOCUMENTS

| | | | |
|---|---|---|---|
| WO | 2007/003503 | A1 | 1/2007 |
| WO | 2007/105964 | A1 | 9/2007 |

OTHER PUBLICATIONS

Machine Translation of DE20316273U1 printed Jul. 24, 2009.

* cited by examiner

POLYGONAL TRAY HAVING REINFORCED CORNERS

CROSS-REFERENCE TO RELATED APPLICATIONS

This application claims benefit of U.S. Provisional Patent Application Ser. No. 61/047,776 entitled "Tray Having Reinforced Corners" filed on Apr. 25, 2008, and is hereby incorporated by reference in its entirety.

TECHNICAL FIELD

The disclosure relates to the art of packaging for shipping and storing products and, more particularly, to a polygonal tray having reinforced corners that is used in packaging, shipping and storing a variety of products.

BACKGROUND

For many years, consumer companies have packaged their products in light weight paperboard trays and shipped such products to a retail outlet or some other location where consumers can purchase the products. There are many different types of trays that can be used for packaging and shipping products from the manufacturer to the retailer. However, many of the trays that are currently available tend to have "flimsy" side walls. The flimsy side walls tend to bow or bend under the weight of certain consumer products. If the side walls bend, it becomes difficult to stack, store, and/or transport products in the trays.

SUMMARY

A tray includes a bottom panel having first, second, third and fourth edge portions. The tray further includes at least one end wall that extends perpendicularly outward from one of the first, second, third, and fourth edge portions of the bottom panel, and at least one side wall that extends perpendicularly outward from another of the first, second, third and fourth edge portions of the bottom panel. The at least one side wall is perpendicular to the at least one end wall. At least one corner extends between the at least one side wall and the at least one end wall. The at least one corner includes an outer member and an inner member. The inner member is folded onto the outer member to reinforce the at least one corner.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE DISCLOSURE

Figure 1:
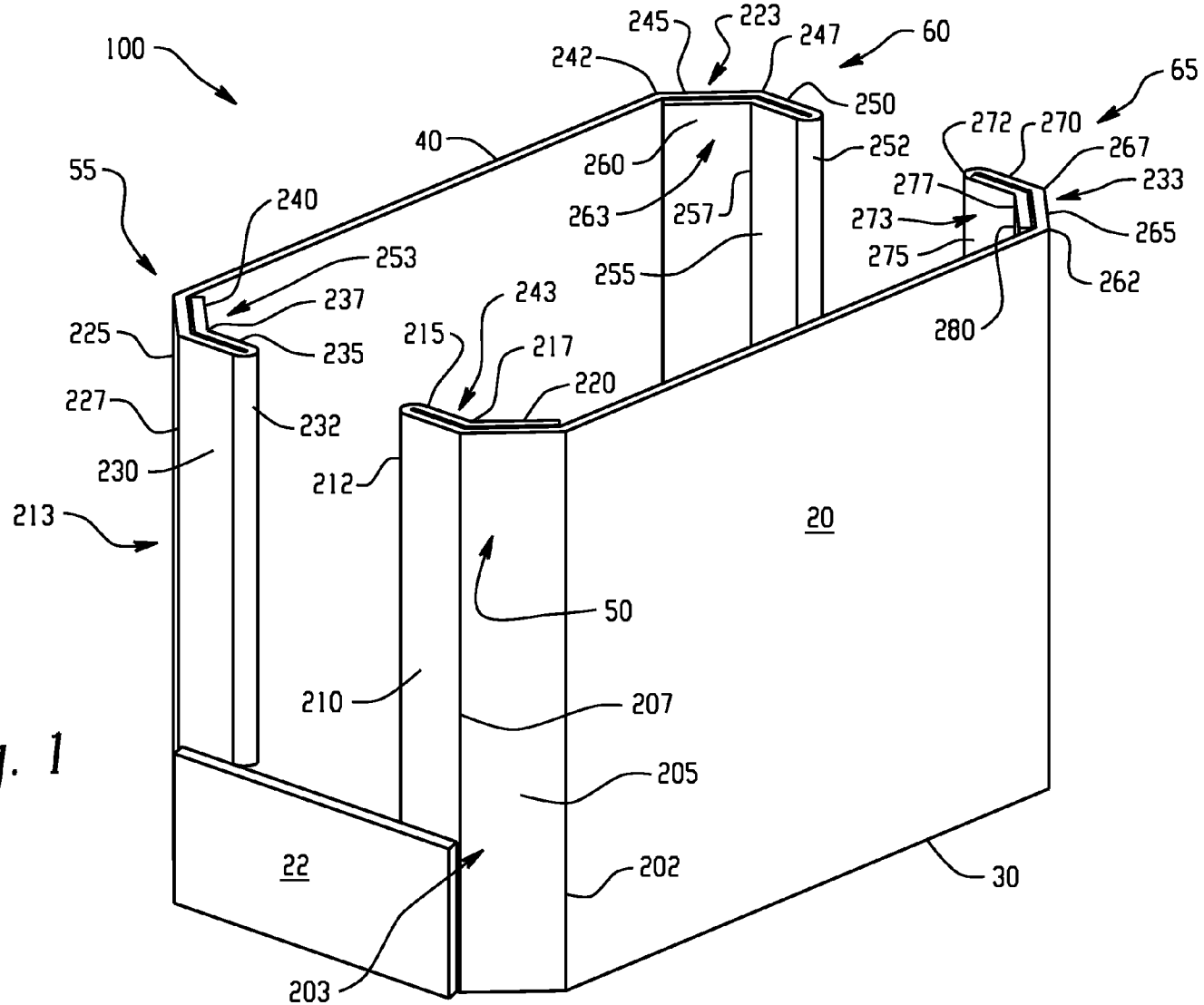
FIG. 1 is a perspective view of a polygonal tray having reinforced corners constructed in accordance with an exemplary embodiment.
Figure 2:
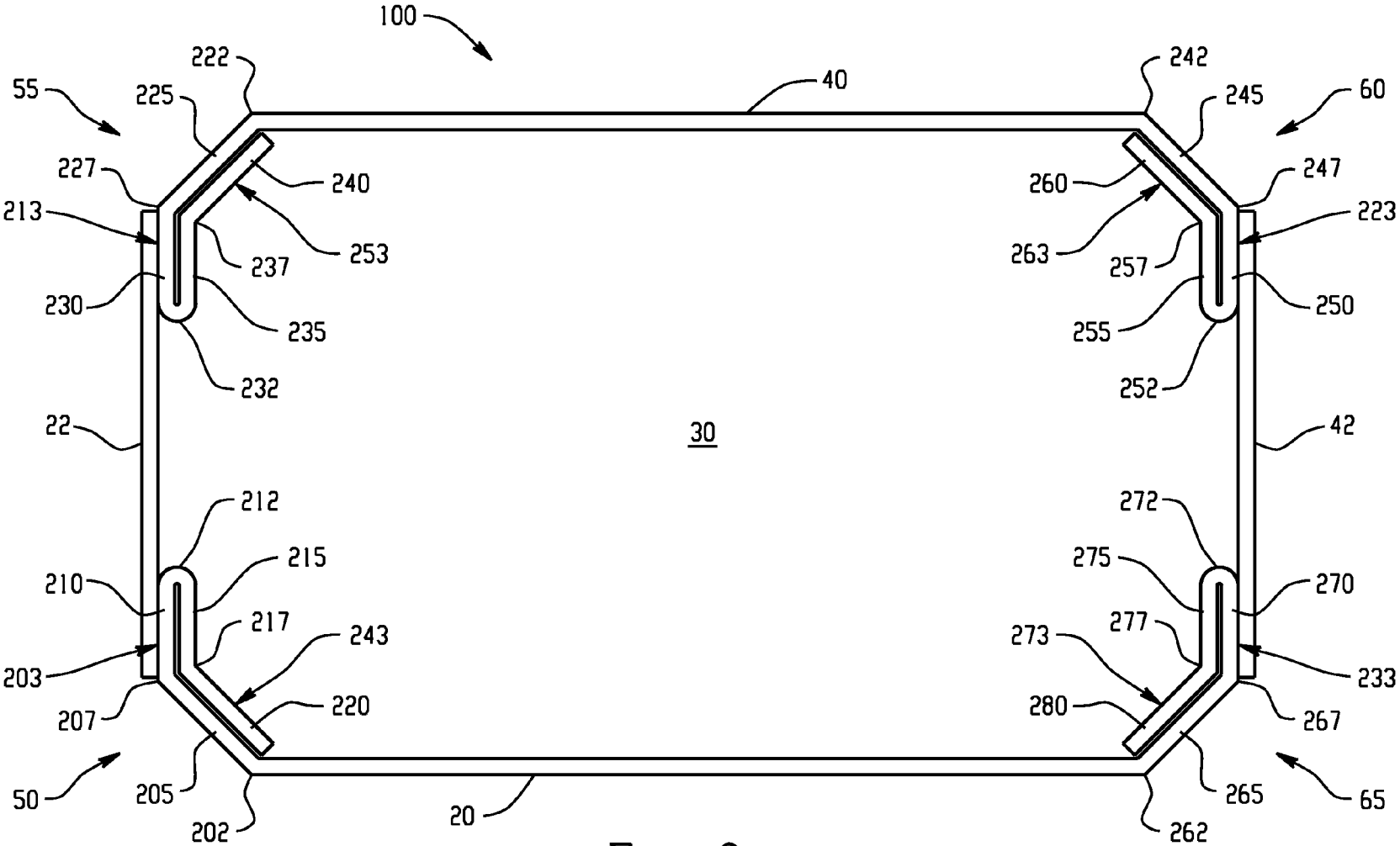
FIG. 2 is a top view of the polygonal tray of FIG. 1.

With reference to FIGS. 1 and 2, a polygonal paperboard tray constructed in accordance with an exemplary embodiment is indicated generally at 100. Tray 100 includes a generally rectangular footprint having a bottom panel 30 having first, second, third, and fourth edge portions (not separately labeled), first and second opposing side panels 20, 40, corners 50, 55, 60, 65, and opposing end walls 22 and 42. End walls 22, 42 extend from the bottom panel 30 and, in the exemplary embodiment shown, attach to corners 50, 55 and 60, 65, respectively. As will be discussed more fully below, corners 50, 55, 60 and 65 are reinforced to provide additional structural integrity to tray 100.

As best shown in FIG. 2 each corner 50, 55, 60, 65 includes a corresponding outer member 203, 213, 223, and 233. Outer members 203 and 233 extend from opposing ends (not separately labeled) of side panel 20, while outer members 213 and 223 extend from opposing ends (not separately labeled) of side panel 40. In addition, each corner 50, 55, 60, and 65 includes a corresponding inner member 243, 253, 263, and 273 that, as will be detailed more fully below, provide reinforcement to outer members 203, 213, 223 and 233 respectively. Inner members 243, 253, 263 and 273 actually extend from respective ones of outer members 203, 213, 223 and 233. In addition, inner members 243, 253, 263, 273 fold inward and abut inner surfaces (not separately labeled) of the outer members 203, 213, 223, 233, respectively. Each outer member 203, 213, 223 and 233 includes first and second outer panels 205, 210; 225, 230; 245, 250; and 265, 270 respectively. Similarly, each inner member 243, 253, 263, 273 includes first and second inner panels 215, 220; 235, 240; 255, 260; and 275, 280 respectively.

In accordance with the exemplary embodiment shown, first outer panels 205, 225, 245, 265 are folded along fold lines 202, 222, 242, 262 towards an inside of tray 100 at approximately 45 degrees with respect to the side panels 20, 40, respectively. Second outer panels 210, 230, 250, 270 are folded along fold lines 207, 227, 247, 267 at approximately 45 degrees with respect to first outer panels 205, 225, 245 and 265. With this arrangement, second outer panels 210, 230, 250, 270 are aligned along a plane (not separately labeled) defined by corresponding ones of end walls 22, 42 (FIG. 2).

In further accordance with the exemplary embodiment shown, first inner panels 215, 235, 255, 275, are folded approximately 180 degrees along fold lines 212, 232, 252, 272 so as to abut and inner surface (not separately labeled) of second outer panels 210, 230, 250, 270, respectively. Second inner panels 220, 240, 260, 280 extend from first inner panels 215, 235, 255, 275 and are folded along fold lines 217, 237, 257, 277 at approximately a 45 degree angle. In this manner, second inner panels 220, 240, 260, 280 abut an inner surface (not separately labeled) of respective ones of first outer panels 205, 225, 245, 265. With this arrangement, inner members 243, 253, 263, and 273 provide support and stabilization to outer members 203, 213, 223, and 233 to reinforce respective ones of corners 50, 55, 60 and 65 so as to maintain an overall structural rigidity of tray 100 and to enhance stacking, storing and transportation of products.

Figure 3:
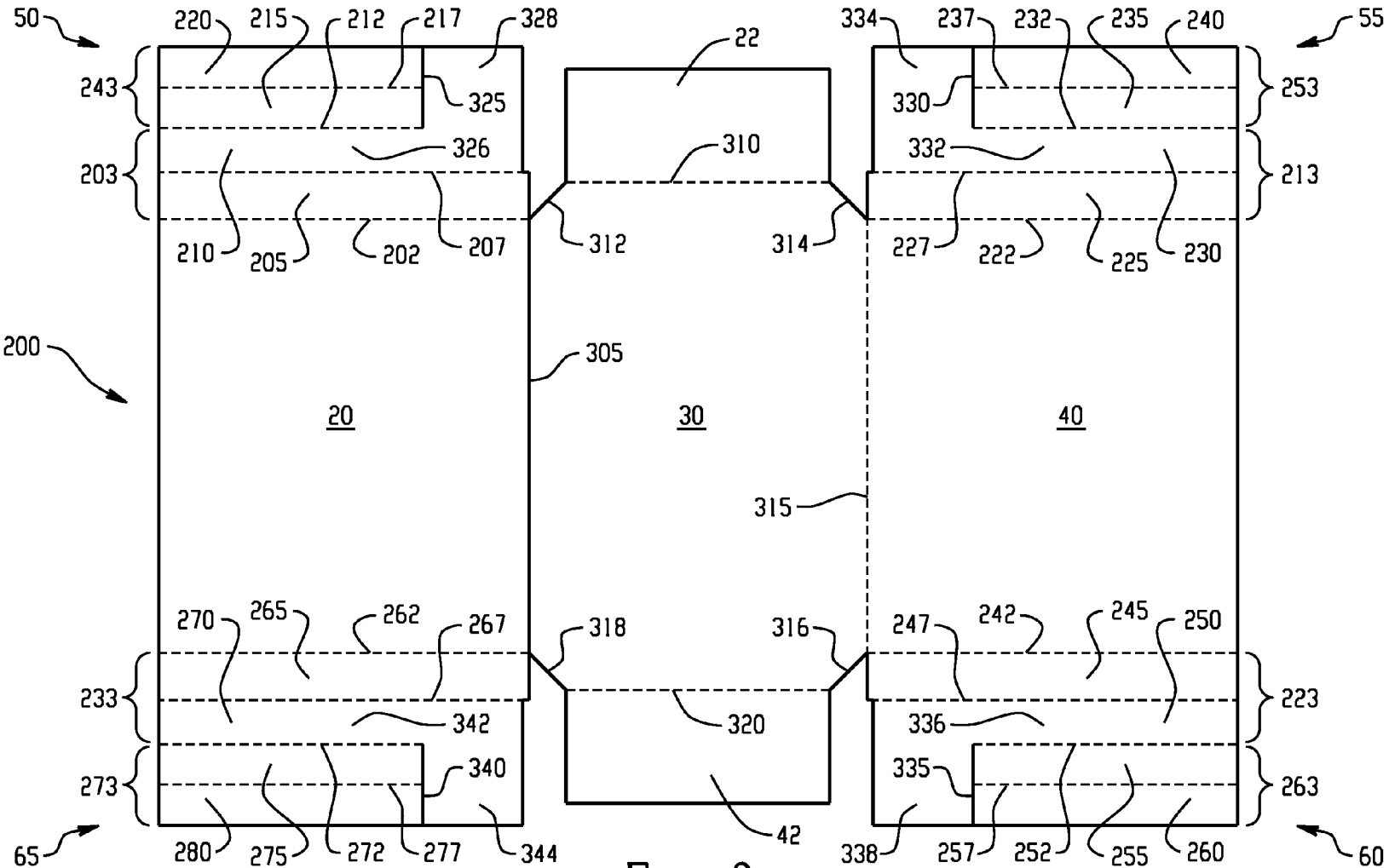
FIG. 3 is a plan view of a blank used to make the polygonal tray of FIG. 1.

Reference will now be made to FIG. 3 in describing a blank 200 employed in connection with the formation of tray 100. As shown, blank 200 includes first side panel 20, bottom panel 30, and second side panel 40. First and second side panels 20 and 40 are connected to opposing sides (not separately labeled) of bottom panel 30 along first and second vertical fold lines 305, 315, respectively. End walls 22 and 42 are connected to other opposing sides (not separately labeled) of bottom wall 30 along fold lines 310, 320, respectively. In addition, bottom panel 30 includes angled corners 312, 314, that extend between side panel 20 and end walls 22 and 42 respectively. In addition, bottom panel 30 includes angled corners 316, 318 that extend between side panel 40 and end walls 22, 42 respectively. More specifically, angled corners 312, 318, interconnect fold line 305 with fold lines 310 and 320 respectively, while angled corners 314, 316 interconnect fold line 315 with fold lines 310 and 320 respectively. With this arrangement, first outer panels 205, 225, 245, 265 can be folded to align with respective ones of angled corners 312, 314, 316, and 318. As further illustrated in FIG. 3, each end wall 22, 42 is generally rectangular in shape and includes a height that is approximately one-quarter a height of each side wall 20, 40.

In further accordance with the exemplary embodiment shown, first outer panels 205, 225, 245, 265 are foldably attached to second outer panels 210, 230, 250, 270 along fold lines 207, 227, 247, 267, respectively. As shown, each second outer panel 210, 230, 250, 270 includes a respective corner flap portion 326, 332, 336, 342 and respective end flap portion 328, 334, 338, 344. Each end flap portion 328, 334, 338 and 344 extends perpendicularly outwardly from a respective one of each corner flap portion 326, 332, 336, and 342 such that each second outer panel 210, 230, 250 and 270 includes a generally L-shaped profile. Corner flaps 326, 332, 336, 342 provide additional reinforcement to corners 50, 55, 60, 65. End flaps 328, 334, 338, 344 facilitate attaching corners 50, 55, 60, 65 and side panels 20, 40 to the end walls 22, 42, respectively. With this arrangement, the height of the end flaps 328, 334, 338, 344 is approximately the same height of the end walls 22, 42.

In still further accordance with the exemplary embodiment shown, corner flaps 326, 332, 336, 342 are foldably attached to first inner panels 215, 235, 255, 275 along fold lines 212, 232, 252, and 272. First inner panels 215, 235, 255 and 275 are foldably attached to second inner panels 220, 240, 260 and 280 along fold lines 217, 237, 257, and 277 respectively. Blank 200 further includes a plurality of cut lines 325, 330, 335, 340 formed between the end flaps 328, 334, 338, 344 and respective ones of inner members 243, 253, 263, 273.

All of the fold lines formed in blank 200 are formed by crushing the paperboard along the line to be folded to facilitate bending of the paperboard to form the various panels and flaps. To assemble tray 100, blank 200 is first folded along the fold lines 305, 315 approximately 90 degrees such that side panels 20, 40 are generally perpendicular to bottom panel 30. Blank 200 is then be folded along fold lines 320, 310 such that end walls 22, 42 are generally perpendicular to the first and second side panels 20, 40 bottom panel 30. At this point, blank 200 is folded along fold lines 202, 222, 242, 262, such that first outer panels 205, 225, 245, 265 of outer members 203, 213, 223, 233 are angled towards corresponding ones of end walls 22 and 42. At this point, first outer panels 205, 225, 245, 265 are substantially in alignment with angled corners 312, 314, 316, and 318 of the bottom panel 30.

Second outer panels 210, 230, 250, 270 are then folded along fold lines 207, 227, 247, 267. In this manner, second outer panels 210, 230, 250 and 270 substantially align along a plane defined by respective ones of end walls 22 and 42. It should be noted that the end flaps 328, 334, 338, 344 of second outer panels 210, 230, 250, 270 can be attached to either an inner or outer surface (not separately labeled) of respective ones of end walls 22 and 42. First inner panels 215, 235, 255, 275 are then folded along fold lines 212, 232, 252, 272 such that first inner panels 215, 235, 255, 275 abut inner surfaces (not separately labeled) of respective ones of second outer panels 210, 230, 250, 270. Second inner panels 220, 240, 260, 280 are then folded along fold lines 217, 237, 257, 277. In this manner, second inner panels 220, 240, 260, 280 abut inner surfaces (not separately labeled) of respective ones of first outer panels 205, 225, 245, and 265.

Figure 4:
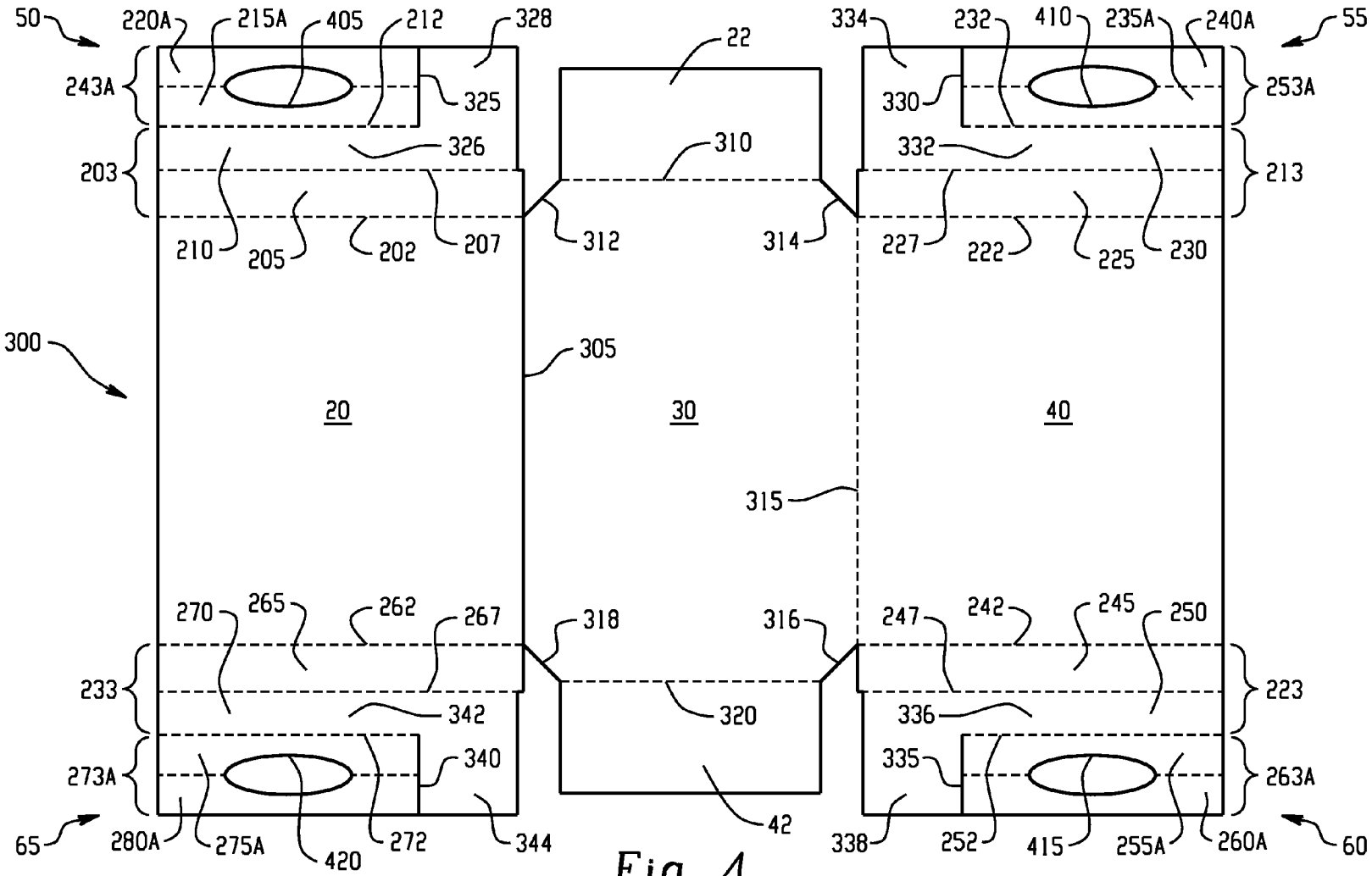
FIG. 4 is a plan view of blank used to make a polygonal tray in accordance with another exemplary embodiment.

Reference will now be made to FIG. 4, wherein like references numbers represent corresponding parts in the separate views in describing a blank 300 constructed in accordance with another exemplary embodiment. As shown, blank 300 includes bottom panel 30, side panels 20, 40, and end walls 22, 42. However, in contrast to blank 200 described above, blank 300 includes inner members 243A, 253A, 263A, and 273A having respective cutout portions 405, 410, 415, 420 that are disposed between first and second inner panels 215A, 220A; 235A, 240A; 255A, 260A; and 275A, 280A, respectively. Cutout portions 405, 410, 415, 420 have a generally elliptical shape and provide structure that eases folding. However, it should be understood that cutout portions 405, 410, 415, 420 can have other shapes, such as, circular, triangular, rectangular, square, and polygonal shapes.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

The invention claimed is:

1. A tray comprising:

a bottom panel having first, second, third and fourth edge portions;

at least one end wall that extends perpendicularly outward from one of the first, second, third and fourth edge portions of the bottom panel;

at least one side wall that extends perpendicularly outward from another of the first, second, third and fourth edge portions of the bottom panel, the at least one side wall being perpendicular to the at least one end wall; and at least one corner extending between the at least one side wall and the at least one end wall, the at least one corner including an outer member and an inner member, the inner member being folded onto the outer member to reinforce the corner;

wherein the outer member includes a first outer panel and a second outer panel;

wherein the inner member includes a first inner panel and a second inner panel; and wherein the first inner panel extends parallel to and is in face-to-face contact with the second outer panel and the second inner panel extends parallel to and is in face-to-face contact with the first outer panel;

wherein a fold line joins the first inner panel and the second outer panel, wherein the fold line is spaced apart from and faces away from the respective at least one side wall, and wherein the second inner panel terminates prior to the respective at least one side wall.

2. The tray according to claim 1, wherein the first outer panel extends at approximately a 45 degree angle from the at least one side wall.

3. The tray according to claim 2, wherein the second outer panel extends at approximately a 45 degree angle from the first outer panel, and wherein the second outer panel extends parallel to and is in face-to-face contact with the at least one end wall.

4. The tray according to claim 2, wherein the second inner panel is disposed parallel to and in face-to-face contact with the first outer panel.

5. The tray according to claim 1, wherein the second inner panel extends at approximately a 45 degree angle from the first inner panel.

6. The tray according to claim 1, further comprising:

a cutout portion formed between the first and second inner panels.

7. The tray of claim 1, wherein the inner member is folded over 180-degrees about a fold line onto the outer member to reinforce the corner.

8. A tray comprising:

a bottom panel having first and second opposing edge portions, and third and fourth opposing edge portions;

a first end wall extending perpendicularly outward from one of the first and second opposing edge portions of the bottom panel;

a second end wall extending perpendicularly outward from another of the first and second opposing edge portions of the bottom panel a first side wall extending perpendicularly outward from one of the third and fourth opposing edge portions of the bottom panel, the first side wall being perpendicular to each of the first and second end walls;

a second side wall extending perpendicularly outward from the other of the third and fourth opposing edge portions of the bottom panel, the second side wall being perpendicular to each of the first and second end walls; and a plurality of corners extending between respective ones of the first and second side walls and the first and second end walls, each of the plurality of corners including an outer member and an inner member, the inner member being folded onto the outer member to reinforce the corresponding one of the plurality of corners;

wherein the outer member includes a first outer panel and a second outer panel;

wherein the inner member includes a first inner panel and a second inner panel;

wherein the first inner panel extends parallel to and is in face-to-face contact with the second outer panel and the second inner panel extends parallel to and is in face-to-face contact with the first outer panel;

wherein a fold line joins the first inner panel and the second outer panel, wherein the fold line is spaced apart from and faces away from the respective one of the first and second side walls, and wherein the second inner panel terminates prior to the respective one of the first and second side walls.

9. The tray according to claim 8, wherein the first outer panel extends at approximately a 45 degree angle from the respective one of the first and second side walls.

10. The tray according to claim 9, wherein the second outer panel extends at approximately a 45 degree angle from the first outer panel, and wherein the second outer panel extends parallel to and is in face-to-face contact with the respective one of the first and second end walls.

11. The tray according to claim 8, wherein the second inner panel extends at approximately a 45 degree angle from the first inner panel.

12. The tray according to claim 11, wherein the second inner panel is disposed parallel to and in face-to-face contact with the first outer panel.

13. The tray according to claim 8, further comprising: a cutout portion formed between the first and second inner panels.

* * * * *